United States Patent [19]

Nagy et al.

[11] Patent Number: 4,691,485

[45] Date of Patent: Sep. 8, 1987

[54] APPARATUS AND PROCESS FOR THE CONSTRUCTION OF MONOLITHIC CEILINGS

[75] Inventors: István Nagy; Ferenc Nagy; István Pozsgai; László Karátson; Andor Gábori; Kálmán Tóth; Jeno Zubretzky, all of Budapest, Hungary

[73] Assignee: Epitestudomanyi Intezet & Konnyuipari Szerelo es Epito Vallalat, Hungary

[21] Appl. No.: 868,802

[22] Filed: May 29, 1986

[30] Foreign Application Priority Data

Nov. 30, 1982 [HU] Hungary ..... 3838/82

[51] Int. Cl.[4] ..... E04B 1/35

[52] U.S. Cl. ..... 52/125.1; 52/236.3; 52/745

[58] Field of Search ..... 52/125.1, 745, 122.1, 52/236.3

[56] References Cited

U.S. PATENT DOCUMENTS

| | | | |
|---|---|---|---|
| 3,363,393 | 1/1968 | Von Heidenstam | 52/125.1 X |
| 3,594,965 | 7/1971 | Saether | 52/125.1 |
| 4,301,630 | 11/1981 | Burkland | 52/125.1 |

FOREIGN PATENT DOCUMENTS

| | | | |
|---|---|---|---|
| 1903550 | 8/1969 | Fed. Rep. of Germany | 52/125.1 |
| 2411773 | 9/1975 | Fed. Rep. of Germany | 52/125.1 |
| 1520379 | 3/1968 | France | 52/745 |
| 67792 | 5/1951 | Netherlands | 52/745 |
| 1041079 | 9/1966 | United Kingdom | 52/745 |
| 730941 | 5/1980 | U.S.S.R. | 52/125.1 |

*Primary Examiner*—J. Karl Bell

*Attorney, Agent, or Firm*—Schweitzer & Cornman

[57] ABSTRACT

The invention relates to an apparatus for the construction of monolithic of multi-level or pillar-framed buildings having suspended ceilings, said apparatus is provided with surface- and in given case working level-forming formwork shell surrounding the monolithic concrete form-space of the ceiling, formwork bearer supporting the formwork shell, furthermore actuating mechanisms, e.g. lifting units for lifting and lowering the formwork bearer, the actuating mechanism, e.g. lifting units are in force-transmitting connection directly or indirectly with a certain part, e.g. pillars of the temporary or permanent vertical load bearing structures of the building, load bearing elements, e.g. bear frame, connecting member, etc. are built in between the formwork bearer and the lifting units.

The essence of the apparatus lies in that the units /7/ are interconnected preferably with storey-high intermediate members /8/ forming forced trajectory for the formwork bearer /3/, furthermore the intermediate members /8/ are provided with releasable hinged bearers /9/ fixed to the vertrical load bearing structure /1/ temporarily holding and temporarily releasing the intermediate members /8/ and allowing the inching movement of the lifting units /7/ .

12 Claims, 10 Drawing Figures

APPARATUS AND PROCESS FOR THE CONSTRUCTION OF MONOLITHIC CEILINGS

Figure 1:
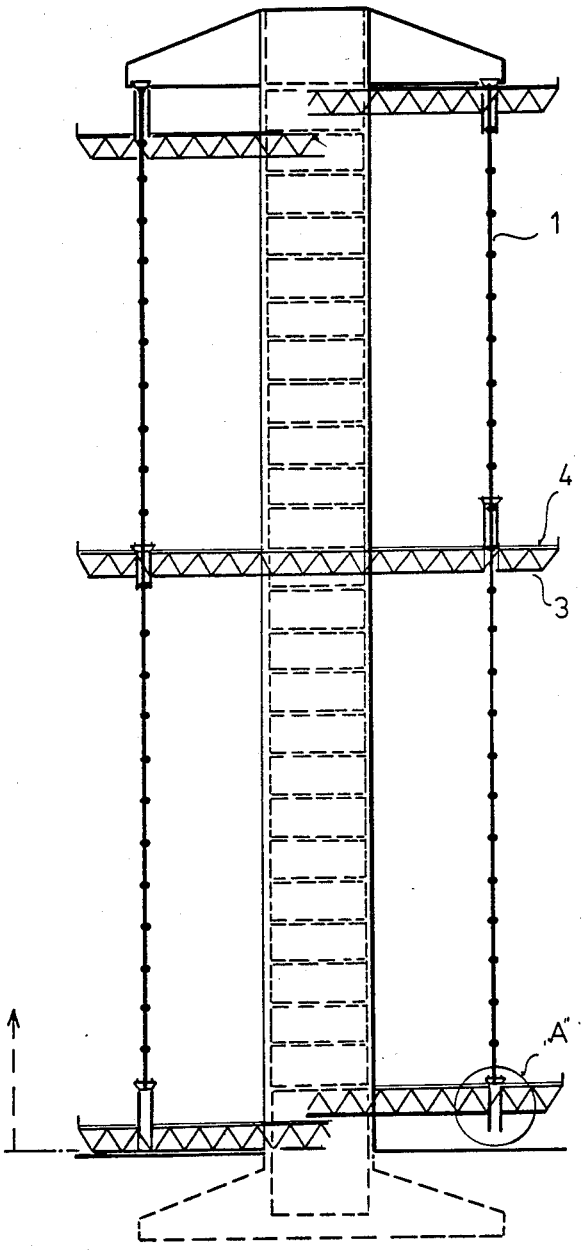

The invention relates to an apparatus and a process for the construction of monolithic ceilings, particularly for monolithic ceilings of multi-level or pillar- framed buildings having suspended ceilings. The apparatus is provided with surface- forming and in given case with working level- forming formwork shell surrounding the monolithic concrete form- space of the ceiling, formwork bearer supporting the formwork shell, furthermore with actuating mechanisms, e.g. lifting units for lifting and lowering the formwork bearer. The actuating mechanisms, e.g. lifting units are in force- transmitting connection directly or indirectly with a certain part, e.g. pillars of the permanent or temporary vertical load bearing structures of the building. Load- transmitting elements, e.g. bear frame, connecting member, etc. are built in between the formwork bearer and lifting units. According to the process the ceilings are built on surface- forming and in given case on working level-forming continuous formwork shell surrounding their form- space and preferably suited to the whole celing panel. The formwork shell is supported by formwork bearer lifted and lowered with actuating mechanisms, e.g. lifting units along the vertical load bearing structures, e.g. pillars of the building prior to construction of the ceilings. The ceilings are built in the order of moving downwards, supported by these vertical load bearing structures.

Execution of the construction tasks with upto-date industrialized methods resulted first of all in the development and general use of the prefabricated structures. Prefabrication however can not be used in every case, hence the monolithic construction process are still needed further on. In the field of the reinforced concrete structures this means that concreting on the site can not be dispensed with, which is realizable only with the use of a lot of casing and scaffolding materials and with considerable amount of manpower. In the case of constructing multi- level buildings, the difficulties are increased by the need of expensive auxiliary mechanisms, e.g. the use of tower crane of high lift.

Construction of the ceiling structures of multi- level industrial buildings represents special problem, in that the concreting on the site is extremely slow. Namely it is well- known that separate scaffold and formwork have to be built for each level, and the formwork can be pulled down only after reaching the full strength of the concrete. The reason for this is that building of the structure is continued from the already completed ceiling as from supporting base, and the loads applied on the already finished ceiling not only reach but in most cases exceed the loads arising in the course of proper in the course of proper use of the building.

For renewal and the more efficient functioning of the traditional methods used for the construction of monolithic ceilings considerable development took place in the last decade. A typical example for these new methods is found in the Swiss patent disclosure No. 566 122. According to this method the formwork used for producing the new ceiling is assemblied by separate units for each bay, without producing a continuous formwork extending to the full level. The order of producing the ceiling structures moves downwards. The formwork units are moved with the aid of winches fixed to the top of the already existing pillars of the building.

The method in question is applicable only to a limited lift, therefore it is unsuitable for the construction of multi- level, high buildings. Owing to its character, moving of the formwork bearer supporting the complete ceiling is not realizable.

In the case of wall structures erected with sliding formwork, ceiling construction method with up-to-date building order moving downwards is recommended in the GFR patent disclosure No 2 207 511. The ceiling structure is produced in parts within the cellular wall sections by volumetric units determined by the latter ones. The lifting mechanisms moving the formwork structure with bridge wires are suspended on diagonally laid beams at the inner corners of the volumetric units made with sliding formwork. In spite of the good ideas found in the specification, the general use of the method can not be reckoned with. First of all because it is unsuitable for the construction of pillar- framed industrial buildings having large internal space. The continuous formwork bearers of the pillar- framed buildings can not be moved with such mechanism, thus there is no way to build the ceiling as a single continuous unit.

A considerably more development method is described in the Hungarian patent specification No. 170 558. In this case the ceilings are built in a downwards moving order. According to this technology the lifting mechanisms and supporting pillars are arranged on the ground level. This structural design is such that they enable the moving of the formwork bearer supporting the full ceiling. The method in question represents considerable progress, but despite its definite advantages it can not be used generally. Namely the supporting pillars limit the height of the building to about max 45 m. The very heavy supporting pillars are also unfavourable—the weight of each is about 5 ton in case of max 45 m height—which load the lifting mechanism just as much as the formwork bearer to be moved. In the latter method the construction technology is complicated by the fact that very heavy separate supporting pillars are needed in any case. Their erection is manpower - demanding and the frequent vertical adjustment is slow and difficult.

The invention is aimed at the development of such apparatus and process which retain the advantages of the last mentioned most developed method, but eliminate its shortcoming. Within this is realizes the construction of suspended ceiling structures of high buildings exceeding even the height of 100 m, without the need of using heavy separate supporting structures.

The objective of the invention is the realization of such apparatus and process, whereby the formwork bearer required for the ceiling structures and in given case other accessories can be lifted without any difficulty to the level of uppermost ceiling along the already existing vertical load bearing structures of the building, even in the case of very high building, and for the construction of the ceiling structures moving downwards they can be lowered step by step at each level.

The invention idea is based on the recognition that the set objective—be it either the construction of suspended ceiling or ceiling structure supported from underneath—can be suitably realized, if in the course of construction the already completed new ceiling is not loaded besides its own dead weight. For this purpose the loads of the ceiling transmitted to the pillars with prefabricates suspending or supporting elements, the formwork is lifted by inching movement from the ground level to the level of the uppermost ceiling, then lowered level by level similarly with inching movement to the position of the next ceiling, and finally to the ground level. The inching movement as the essential part of the invention idea is realized with releasable hinged bearers, whereby temporary connection can be brought about between the lifting units moving the formwork bearer and the intermediate members forming their forced trajectory.

In accordance the objective, the apparatus according to the invention for the construction of monolithic ceilings, particularly for monolithic ceilings of multi-level or pillar-framed multi- level buildings having suspended ceilings is designed in such a manner that the lifting units are interconnected preferably with storey-high intermediate members forming the forced trajectory of the movement for the formwork bearer, and the intermediate members are provided with releasable hinged bearers fixed to the vertical load bearing structure suitable for clamping the intermediate members and allowing the inching movement of the lifting units along the intermediate members. The apparatus is provided with surface- and working level- forming formwork shell surrounding the monolithic concrete form- space of the ceiling, formwork bearer supporting the formwork shell, furthermore moving mechanisms, e.g. lifting units suitable for lifting and lowering of the formwork bearer, the moving mechanisms, e.g. lifting units are in force-transmitting connection directly or indirectly with a certain part, e.g. pillars of the permanent or temporary vertical load bearing structures, and load- transmitting elements, e.g. bear frame, connecting member, etc. are built in between the formwork bearer and lifting units.

According to a further criterion of the apparatus according to the invention the intermediate members are vertical suspension bars suspended on releasable hinged bearers suitable for the intermittent upward and downward movement of the formwork bearer, or in another case they are vertical supporting bars resting on releasable hinged bearers and suitable for the intermittent upward and downward movement of the formwork bearer.

In the former case the suspension bars are connected with clamp for jointing the completed ceiling and intermediate members. The formwork bearer is provided with temporary supporting bars during its lifting and lowering.

In a suitable construction of the apparatus the releasable hinged bearers are formed by unfolding pairs of rockers. The lifting unit and intermediate member are interconnected with screw joint, or with friction joint, e.g. clamp jaw.

The process according to the invention- where the ceilings are built on continuous formwork shell, preferably suited to the whole ceiling panel surrounding the form- space of the ceilings, at the same time forming the surface and in given case the working level, the formwork shell is supported by formwork bearer, which is lifted and lowered with the aid of actuating mechanisms, e.g. lifting units along vertical load bearing structures, e.g. pillars erected prior to construction of the ceilings, the ceilings are built in downward order supported by the vertical load bearing structures—is based on that in the first phase of the construction the core of the building serving for the horizontal stability, e.g. staircase or elevator shaft, in given case the structural parts suitable for suspension of the ceilings are built in addition to the vertical load bearing structures, e.g. pillars, then in the second phase of the construction first the formwork shell and the supporting formwork bearer are assembled and lifted to the level of the uppermost ceiling with the aid of lifting units along the vertical load bearing structures, e.g. pillars releasably connected to them, and moved preferably along storey-high intermediate members, where its position is accurately adjusted and fixed for example with temporary supporting bars, then the ceiling is built, and upon reaching the strength of the concrete, the temporary clamping is released. The whole formwork bearer is lowered to the level of the next ceiling with the aid of lifting units preferably along storey- high intermediate members, then adjustment in the new position is formed by fixing with temporary supporting bars, then the intermediate members serving for the forced trajectory are lowered with the lifting units below the ceiling is completed, and the aids used for its movement are removed.

According to a possible method of the process the intermediate members are suspended on the vertical load bearing structure of the building, e.g. on releasable hinged bearers fixed to pillars, and the formwork bearer is lifted along the intermediate members filling in the role of the suspension bars with intermittent movement to the level of the uppermost ceiling. According to the other possible method the intermediate members are connected to the vertical load bearing structure of the building, e.g. to releasable hinged bearers fixed to pillars, and the formwork bearer is lifted along the intermediate members filling in the role of supporting bars with intermittent movement to the level of the uppermost ceiling. In any construction method of the process, upon setting of the concrete of each ceiling, the intermediate members are suspended with clamp on to the temporarily completed ceiling, or are supported by releasable hinged bearers, and the formwork of the completed ceiling is dismantled by lowering the formwork bearer with the lifting units.

The apparatus and process according to the invention have many advantages. Among those it is significant that its range of applicability exceeds by far that of the most advanced methods known so far, and thus the suspended ceiling structures of the buildings even over the heights of 1oo m can be built with well mechanized, automated and productive construction technology. The apparatus and process according to the invention considerably facilitate and simplify the construction of large monolithic reinforced concrete ceilings, which is attributed to the fact, that the casing and scaffolding as the most manpower-demanding processes of the monolithic construction technology are successfully carried out with minimal live labour and within a short time.

The simplicity and efficiency of the method are attributed to moving the complete continuous formwork bearer along the already existing vertical load bearing structures of the building. the forces are transmitted to it, and the lifting and lowering take place with inching movement, preferably with the use of storey- high intermediate members. This way there is no need of heavy separate supporting structures, the assembly and disassembly and frequent adjustment of which cause problem at the known processes.

With the aid of the inching movement the continuous formwork bearer is lifted quickly and simply to the height of the uppermost ceiling, and just as quickly and simply is lowered the complete formwork bearer during the downward order of construction of the ceilings until the initial position on the ground level is reached again. The formwork bearer and other aids can be used several times, resulting in considerable saving in material and manpower.

The invention is described in detail by way of examples with the aid of drawings, in which:

FIG. 1.: Lifting of the formwork bearer

Figure 2:
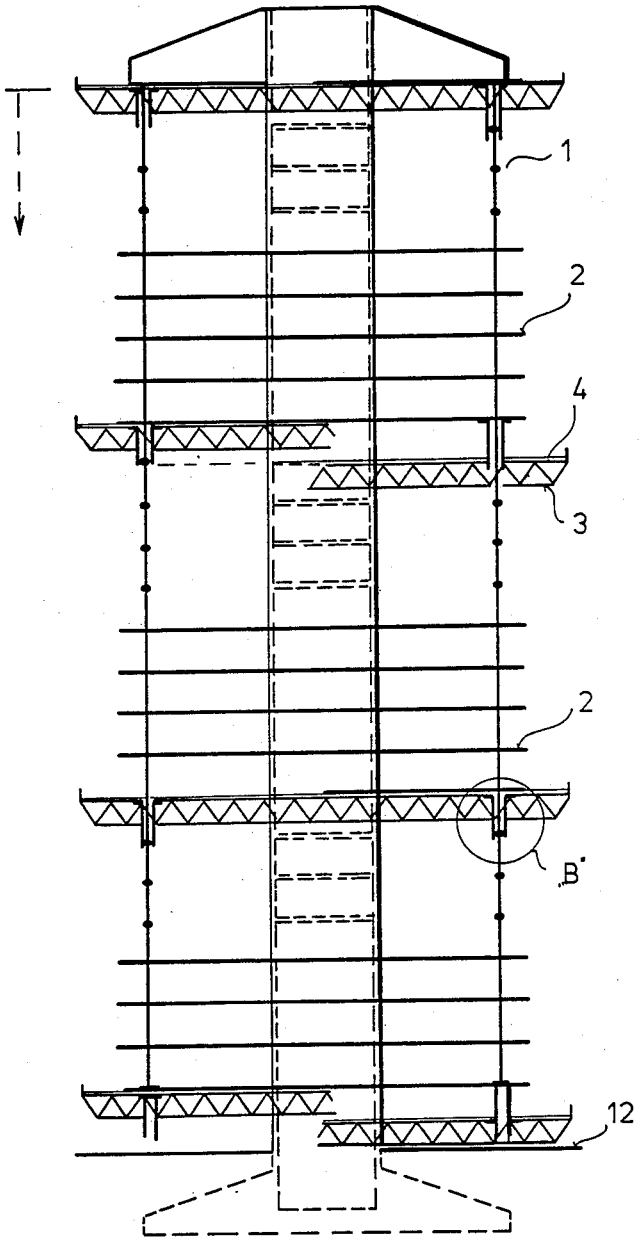

FIG. 2.: Order of construction of the ceilings

Figure 3:
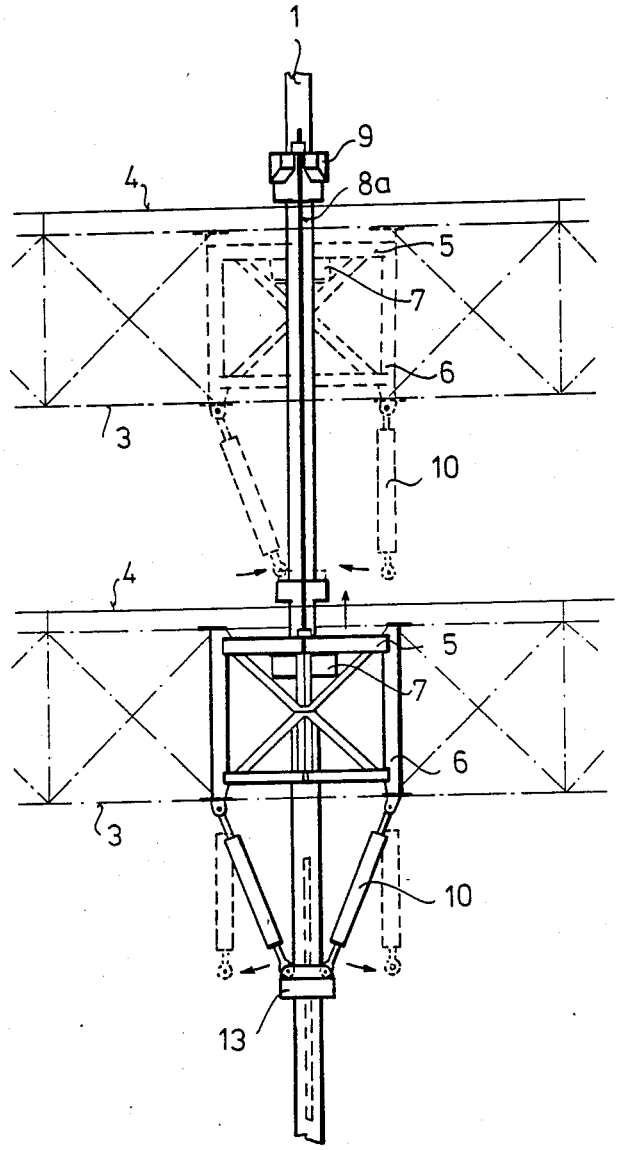

FIG. 3.: Front view of detail "A" marked in FIG. 1., drawn to enlarged scale

Figure 4:
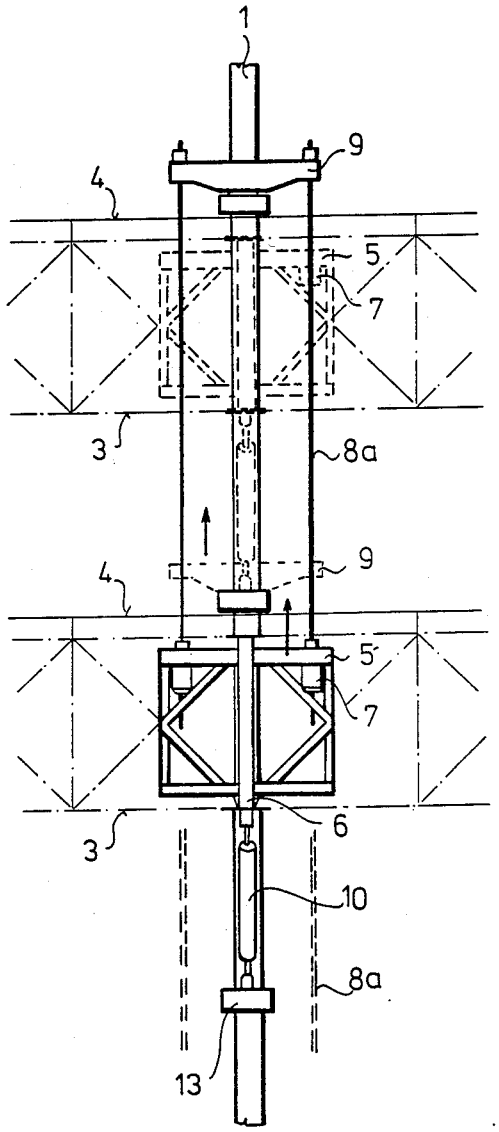

FIG. 4.: Side view of the same

Figure 5:
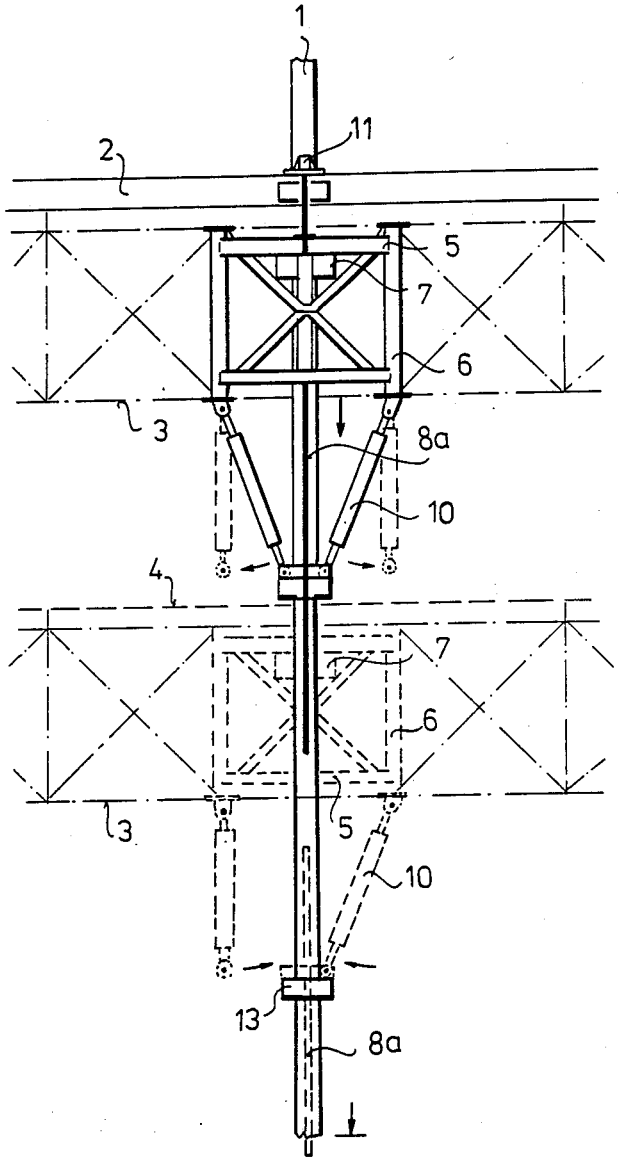

FIG. 5.: Front view of detail "B" marked in FIG. 2., drawn to enlarged scale

Figure 6:
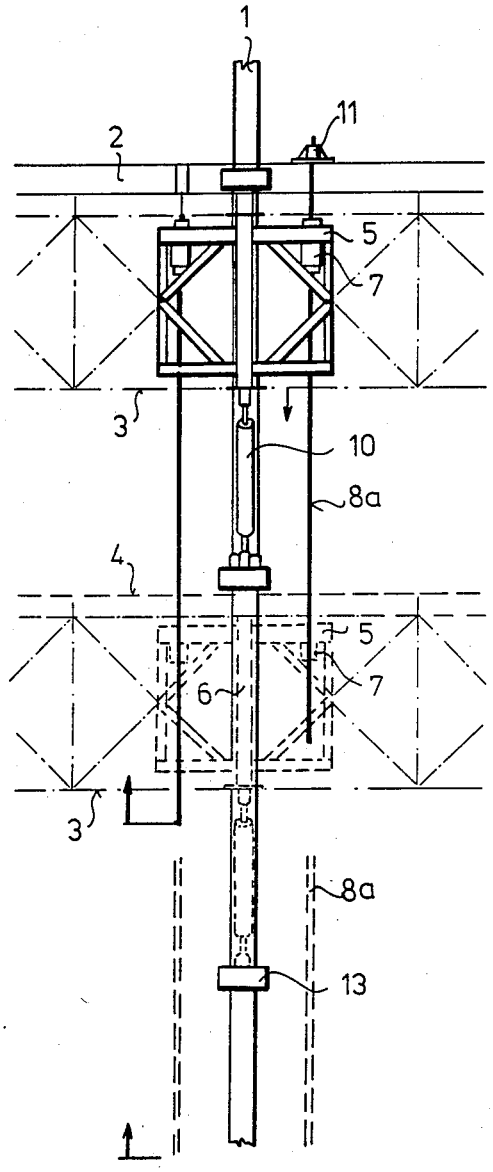

FIG. 6.: Side view of the same

Figure 7:
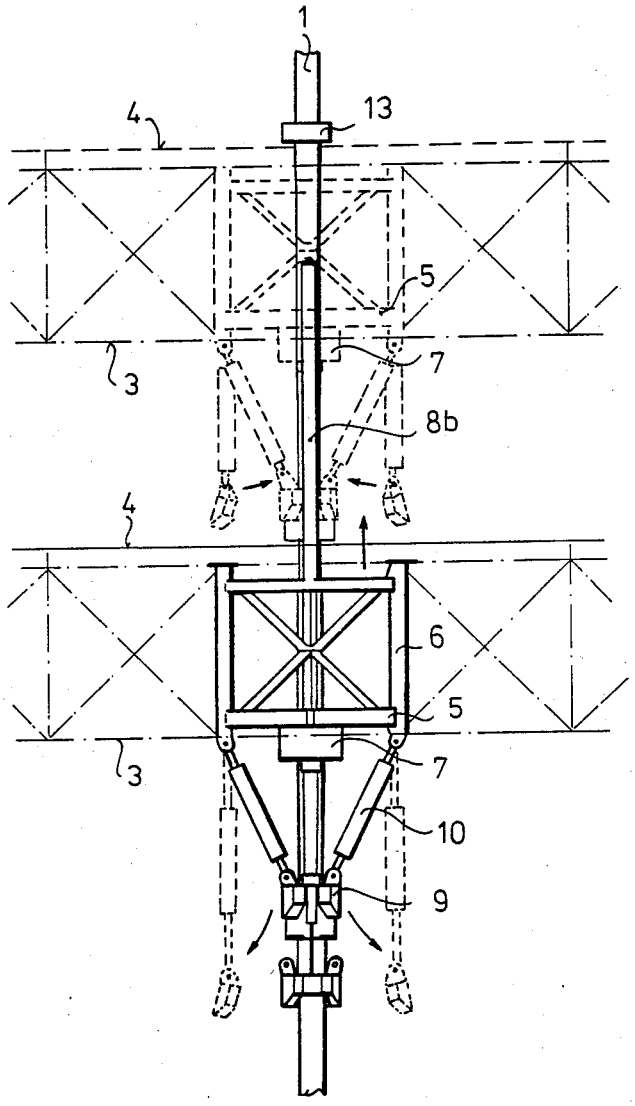
Figure 8:
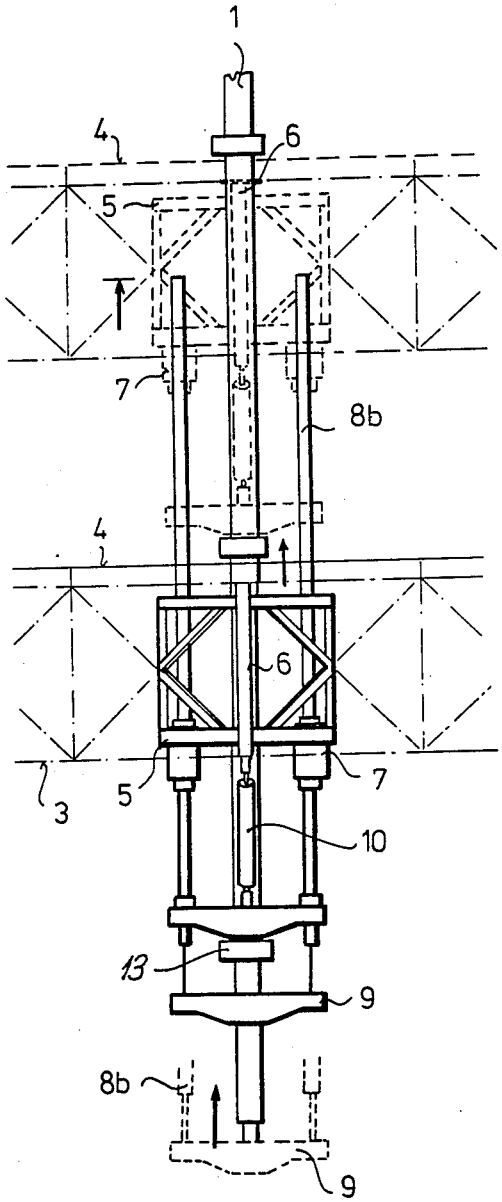

FIG. 7.: Coaction of the lifting, supporting bars and the releasable hinged bearers at lifting shown in front view FIG. 8.: Side view of the same FIG. 9.: Coaction of the lifting unit, supporting bars and the releasable hinged bearers at lowering shown in front view FIG. 10.:Side view of the same.

FIG. 1. shows in the form of line diagram the vertical load bearing structure 1 of a building assumed to be very high, along which the formwork bearer 3 provided with formwork shell 4 can be lifted by inching movement to the height of the uppermost ceiling 2 /not shown in the drawing/. Similar line diagram shows in FIG. 2. the order of downward construction of the ceilings 2, that takes place by gradual downward inching movement of the continuous, complete formwork bearer 3 provided with formwork shell 4 along the vertical load bearing structures 1. The formwork bearer 3 started form and arriving at the ground level 12, finally can be dismantled and used again.

The front and side views of detail "A" marked in FIG. 1. are shown in FIGS. 3. and 4., when the formwork bearer 3 is lifted with inching movement. The movement is carried out by the controlled coaction of the lifting units 7, releasable hinged bearers 9 and storey- high intermediate members 8.

The intermediate members 8 form the forced trajectory for the formwork bearer 3 moved by lifting units 7. In this case the intermediate members 8 are designed in the form of suspension bars 8*a*. The formwork bearer 3 is generally a simple light framework supplemented with bear frame 5 supported by lifting units 7 in the position of lifting, as well as with connecting elements 6 increasing the local stability of the formwork bearer 3 in the position of lifting, and transmitting the forces transferred by the temporary supporting bars 10.

The releasable hinged bearer 9 fixed to the vertical load bearing structure 1 suspended along the upper ends of the suspension bars 8*a* is shown in FIGS. 3. and 4. FIG. 4. clearly shows the arrangement of the suspension bars 8*a* connected in pairs to the releasable hinged bearer shaped as rocker and their connection to the bear frame 5 sitting on lifting units 7.

Upon commencement of the inching movement, the temporary supporting bars 10 adjoining similarly the vertical load bearing structure 1 along stool 13, support the formwork bearer 3 in its initial position. When the hydraulically or mechanically functioning lifting unit 7 starts to work, it pushes the formwork bearer 4 upwards by bear frame 5, while the temporary supporting bars 10 losing their role remain vertically suspended below the formwork bearer 3. Meanwhile the releasable hinged bearer 9 is engaged with the vertical load bearing structure 1 in fixed position, and similarly stationary are suspension bars 8a forming the forced trajectory of the upward inching movement for the formwork bearer 3.

The lifting units are arranged suitably in pairs at each lifting point. In the end position of the lifting stroke they hold the formwork bearer 3 until it is supported again by the vertical load bearing structure 1 with the aid of the temporary bearers 10. This work- phase is shown in the upper part of FIG. 3.

Naturally the force transmitting connection between the releasable hinged bearers 9 and the vertical load bearing structure 1 has to be terminated before the further upward inching movement of the formwork bearer 3, and the releasable hinged bearers 9 are fixed to the vertical load bearing structure 1 in their higher position.

FIGS. 5. and 6. shown the downward inching movement in front and side view respectively. This is the explanation of detail "B" marked in FIG. 2. It shows completion of the ceiling 2 and it can be used for lowering the formwork bearer 3. In this case the suspension bars 8*a* are suspended on the already finished and solidified ceiling 2 with the aid of clamps 11.

The lifting units 7 supporting the bear frame 5 start out of their upper extreme position as shown in FIGS. 5. and 6. Prior to the inching movement the loads of the formwork bearer 3 are transferred by the temporary supporting bars 10 through stool 13 to the vertical load bearing structure 1. In the interest of the downward movement naturally the force transmitting connection between the temporary supporting bars 10 and stool 13 has to be terminated. As a result, the temporary supporting bars 10 remain again suspended below the formwork bearer 3.

Upon actuation of the lifting units 7 the latter ones are lowered along the suspension bars 8*a*. Together with those are lowered the bear frame 5 and the supported formwork bearer 3. The suspension bars 8*a* remain in fixed position and form the forced trajectory of the downward inching movement. Upon completion of the lowering—i.e. in the lower extreme position of the stroke of the lifting units 7—the formwork bearer 3 stops, and with the aid of the temporary supporting bars 10 it can be supported again by the vertical load bearing structure 1 through stool 13.

Lowering of the formwork bearer with above method can be carried out with intermittent inching movement as the earlier mentioned lifting process. The intermediate members 8- formed either as suspension bars 8*a* or supporting bars 8*b*—should be storey- high in order to realize the inching movement between the two adjacent levels without reassembly of the connection between the lifting units and the formwork bearer 3.

According to another construction of the apparatus according to the invention the role of the intermediate members 8 is filled in by the supporting bars 8*b*. The front and side views of the upward inching movement are shown in FIGS. 7. and 8. respectively. The lifting unit 7 exerts the lifting force to the formwork bearer 3 through the bear frame 5 and connecting elements 6. The supporting bar 8*b* serves for the forced trajectory of the movement, which in this case is not suspended to the vertical load bearing structure 1 of the building, but it rests on it.

The lifting unit 7—similarly as in the former example—moves upwards along the supporting bars 8*b*, while it pushes the formwork bearer 3 above itself. Thus the formwork bearer 3 too moves upwards along the supporting bar 8*b* according to the stroke of the lifting unit 7. In the initial position shown on the lower part of FIGS. 7. and 8., the temporary supporting bars 10 first rest on the releasable hinged bearers 9 fixed to the vertical load bearing structure 1, then since in the course of the upward movement of the formwork bearer 3 their supporting role is no longer needed, they swing into vertical position shown with dashed line in the drawing.

When the formwork bearer 3 arrives at the higher position it can be fixed again to the vertical load bearing structure 1 with the aid of the temporary supporting bars 10 and releasable hinged bearers 9. The formwork bearer 3 in this higher position together with the other parts of the actuating mechanism is shown on the upper part of FIGS. 7. and 8.

Figure 9:
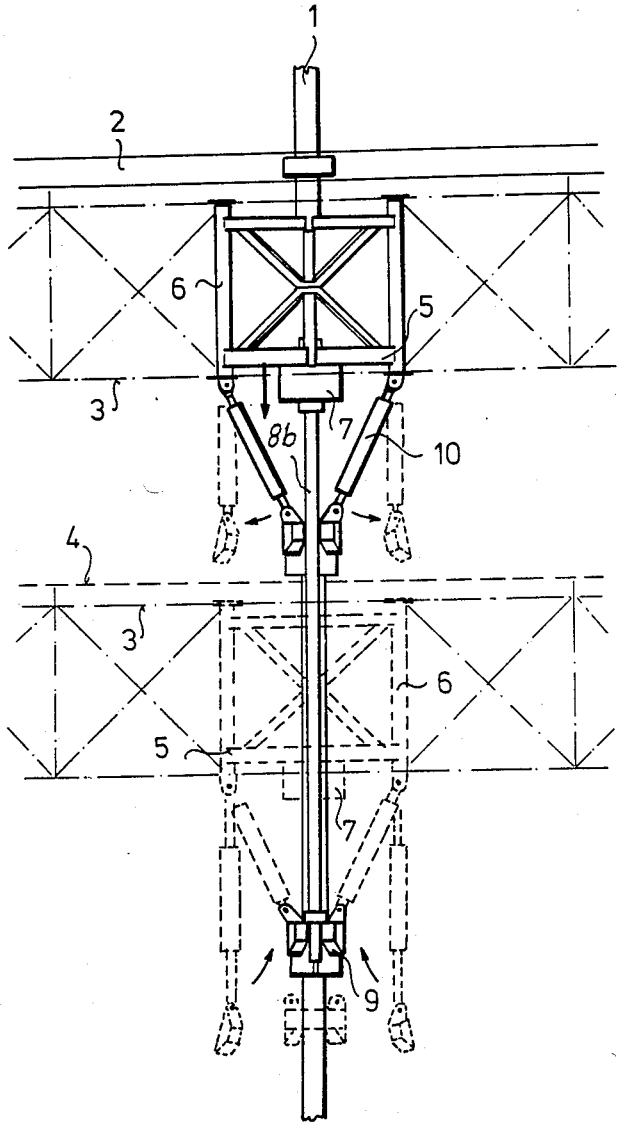
Figure 10:
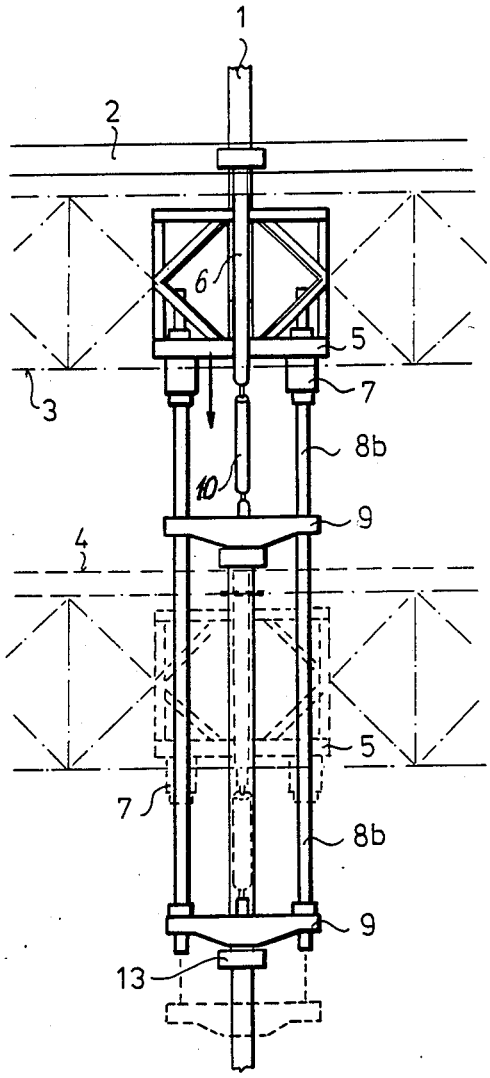

FIGS. 9. and 10. show likewise the construction with supporting bars 8*b*, but in this case the lowering by inching movement. The upper part of FIGS. 9. and 10. shows the initial position, and the lower part of the same drawings shows the condition after lowering. The formwork bearer 3 sits on the lifting units 7 by way of the bearer frame 5 and the connecting elements 5.

The lifting unit 7 moves down along the supporting member 8*b* as forced trajectory according to its stroke, while it pulls along the formwork bearer 3. The formwork shell 4 arranged on the formwork bearer 3 separates from the completed ceiling 2 and thus the formwork is automatically removed. As it can be observed in FIG. 9. there is no need for clamps 11, because the completed ceiling 2 is not used for its downward inching movement.

The structural design of the apparatus according to the invention makes the lifting and lowering operations of the formwork bearer 3 simple and productive. Since the vertical load bearing structure 1 of the building, generally the pillars are used for both operations, hence these have to be built in the first phase of the construction.

Similarly in the first phase of the construction is the internal reinforcing core of the builiding built, e.g. the staircase or elevator shaft, serving for the horizontal stability. Thereafter the formwork bearer 3 and the supported formwork shell 4 are assembled in the second phase of the construction. In accordance with the order of the downward construction of the ceiling the formwork bearer 3 is lifted to the height of the uppermost ceiling 2.

During concreting of the ceiling 2 the formwork bearer 3 is fixed to the vertical load bearing structure 1 with the aid of temporary supporting bars 10. This support is maintained until the ceiling 2 reaches the strength required for removal of the formwork. This is followed by lowering the complete formwork bearer 3—without any disassembly—along the intermediate members 8 with the aid of lifting units 7 to the position corresponding to the level of the next ceiling 2.

After lowering, the formwork bearer 3 is stabilized in relation to the vertical load bearing structure 1 with the aid of the temporary supporting bars 10, and the intermediate members 8 are reassambled below the next ceiling to be built, to be available again for the next downward inching movement. This sequence of operations is repeated cyclically until the last ceiling is completed. Then the formwork bearer 3 is dismantled.

The inching movement of the formwork bearer 3 as a comprehension whole is carried out in the course of lifting and lowering with the aid of the so called automatic height compensator. The automatic height compensation is attained with a conventional synchronizer not subject of the invention.

The synchronizer functions in such a manner, that the next movement after a certain phase of the inching movement can take place only when all the lifting units 7 performed the required lifting or lowering movement. The synchronizing process of nothing else but the coordinated realization of the intermittent step by step movement /inching/ of the whole formwork bearer. The lifting units 7 are operated either hydraulically or mechanically.

The apparatus and the process according to the invention are applicable to advantage for the construction of supported ceiling- structural or pillar- supported skeleton building with optional spacing and number of levels. Complete ceiling panel the size of which is fixed or in given case exceeding the size fixed by the vertical load bearing structures 1, e.g. pillars, can be built with monolithic technology easier, quicker and in a more simple way than with the methods used so far. The significance of the method is accentuated first of all by the fact, that the most labour- demanding process of the monolithic construction, i.e. the casing and scaffolding become considerably more efficient. Substantial is the saving in the casing material, which is consequent upon utilization several times of the casing materials.

What we claim is:

1. Apparatus for the construction of monolithic ceilings, particularly for monolithic ceilings of multi-level or pillar-framed buildings having suspended ceilings, said apparatus is provided with surface- and in given case working level- forming formwork shell surrounding the monolithic concrete form- space of the ceiling formwork bearer supporting the formwork shell, furthermore actuating mechanisms, e.g., lifting units for lifting and lowering the formwork bearer, the actuating mechanisms, e.g., lifting units are in force-transmitting connection directly or indirectly with a certain part, e.g., pillars of the temporary or permanent vertical load bearing structures of the building, load bearing elements, e.g., bear frame, connecting member, etc., are built in between the formwork bearer and the lifting units, characterized in that the lifting units /7/ are interconnected preferably with storey- high intermediate members /8/ forming forced trajectory for the formwork bearer /3/, furthermore the intermediate members /8/ are provided with releasable hinged bearers /9/ fixed to the vertical load bearing structure /1/ temporarily holding and temporarily releasing the intermediate members /8/ whereby to allow an inching movement of the lifting units /7/.

2. Apparatus as claimed in claim 1., characterized in that the intermediate members /8/ are vertical suspension bars /8*a*/ suspended on releasable hinged bearers /9/, suitable for intermittent upward inching movement of the formwork bearer /3/.

3. Apparatus as claimed in claim 1., characterized in that the intermediate members /8/ are vertical supporting bars /8*b*/ resting on the releasable hinged bearers /9/and suitable for the intermittent lowering of the formwork bearer /3/.

4. Apparatus as claimed in claim 3., characterized in that the supporting bars /8*b*/ are provided with clamp /11/ serving for connection between the completed ceiling /2/ and intermediate members /8/.

5. The apparatus according to claim 1, characterized in that temporary supporting bars /10/ are built in between the formwork bearer /3/ and releasable hinged bearers /9/ to support the formwork bearer /3/ during its lifting.

6. The apparatus according to claim 1, characterized in that the releasable hinged bearers /9/ are formed by unfolding pairs of rockers.

7. The apparatus according to claim 1, characterized in that the lifting unit /7/ and intermediate member /8/ are interconnected with screw joint.

8. The apparatus according to claim 1, characterized in that the lifting unit /7/ and intermediate member /8/ are interconnected with friction joint, e.g. clamp jaw.

9. Process for the construction of monolithic ceilings, particularly for monolithic ceilings of multi-level or pillar- framed buildings having suspended ceilings, where the ceilings are built on surface- and in given case on working- level- forming formwork shell surrounding the form- space of the ceilings, the formwork shell is supported with formwork bearer, lifted and lowered by actuating mechanisms, e.g. lifting units along vertical load bearing structures, e.g. pillars of the building built prior to production of the ceilings, and the ceilings are built in the order of moving downwards supported by the vertical load bearing structures, characterized in that in the first phase of the construction, in addition to the vertical load bearing structures, e.g. pillars, the core of the building, e.g. staircase or elevator shaft serving for the horizontal stability, in given case the structural parts suitable for suspension of the ceilings are also built up, then in the second phase of the construction first the formwork shell /4/ and the supporting formwork bearer /3/ are assembled and lifted along the pillars /1/ to the level of the uppermost ceiling /2/, where it is accurately adjusted, and fixed for example with temporary supporting bars /10/, then the ceiling is built, upon reaching the strength of the concrete for removal of the formwork, the temporary fixing is released and the formwork bearer /3/ is lowered to the level of the next ceiling /2/ with the aid of lifting units /7/ inching preferably along storey- high intermediate members /8/ serving for forced trajectory of the formwork bearer /3/, then after adjustment in the new position it is fixed again for example with temporary supporting bars /10/, followed by moving the intermediate members /8/—serving for forced trajectory-below the ceiling to be built with the aid of lifting units /7/, the sequence or processes is repeated cyclically until the last ceiling /2/is completed, finally the formwork bearer /3/ is dismantled and the aids used for its actuation are removed.

10. Process as claimed in claim 9., characterized in that the intermeidate members /8/ are suspended on releasable hinged bearers /9/ fixed to the vertical load bearing structure /1/, e.g. pillars of the building, and the formwork bearer /3/ is lifted with intermittent movement along the intermediate members /8/ filling in the role of suspension bars /8*a*/ to the level of the uppermost ceiling /2/.

11. Process as claimed in claim 9., characterized in that the intermediate members /8/ are connected to releasable hinged bearers /9/ fixed to the vertical load bearing structure /1/, e.g. pillars of the building, then the formwork bearer /3/ is lifted with intermittent movement along the intermediate members /8/ filling in the role of supporting bars /8*b*/ to the level of the uppermost ceiling /2/.

12. The process according to claim 9, characterized in that following the solidification of the concrete of each ceiling /2/ the intermediate members /8/ are suspended temporarily on the completed ceiling /2/ with the aid of clamp /11/, and by lowering the formwork bearer /3/ with the lifting units /7/, the formwork of the completed ceiling /2/ is removed.

* * * * *